United States Patent [19]

Spor

[11] 4,423,898

[45] Jan. 3, 1984

[54] FIREWOOD CARRIER

[76] Inventor: Herman Spor, Rte. 1, Box 284, Lexington, Okla. 73051

[21] Appl. No.: 363,955

[22] Filed: Mar. 31, 1982

[51] Int. Cl.[3] ..... A47J 49/00

[52] U.S. Cl. ..... 294/9

[58] Field of Search ..... 294/9–11, 294/14–16, 27 R, 28, 30, 32, 49, 51, 55.5, 57, 58, 137, 167, 169

[56] References Cited

U.S. PATENT DOCUMENTS

| | | | |
|---|---|---|---|
| 1,742,727 | 1/1930 | Richards | 294/14 |
| 1,902,685 | 3/1933 | Baldwin | 294/11 |
| 3,141,695 | 7/1964 | Furber | 294/30 X |
| 4,248,464 | 2/1981 | Cross | 294/9 |
| 4,354,702 | 10/1982 | Clements et al. | 294/9 |

*Primary Examiner*—Johnny D. Cherry

*Attorney, Agent, or Firm*—Laney, Dougherty, Hessin & Beavers

[57] ABSTRACT

A firewood carrier which includes a pair of elongated rigid rods interconnected by a pair of spaced handle bars. The rods are projected through holes in the handle bars and retained against rotation about their longitudinal axes by fasteners projected into opposite ends of the handle bars. The fastener arrangement permits the rods to be axially rotated to selected positions in which an elongated stick of firewood may be supported in longitudinal alignment with the carrier for placement in a wood burning stove, or alternatively, may be supported in a transversely extending position on the carrier for loading into an open fireplace.

3 Claims, 3 Drawing Figures

FIREWOOD CARRIER

BACKGROUND OF THE INVENTION

1. Field of the Invention

This invention relates to devices useful for lifting and loading firewood logs into fireplaces and wood burning stoves.

2. BRIEF DESCRIPTION OF THE PRIOR ART

Numerous devices have been proposed for use in lifting and loading logs of firewood into open, wood burning fireplaces. Other generally similar devices have been proposed for permitting firewood logs of from 18 inches to 30 inches in length to be lifted and thrust end-wise into the openings for receiving the wood consumed in wood burning stoves.

In general, devices of this type seek to accomplish two purposes. First, it is a desideratum of their construction that the user not be required to touch or directly handle the firewood, thus soiling the hands and risking impailment with splinters. Second, such devices generally afford some leverage which permits the firewood logs to be more easily lifted and placed. This is a particularly desirable feature of the devices from the standpoint of women who may be loading wood into the fireplace or stove.

Examples of devices of the type described which are known to me are those firewood carrying structures which are shown in U.S. Pat. No. 4,299,525 to Coffman; U.S. Pat. No. 4,176,871 to Stover; U.S. Pat. No. 4,248,464 to Cross; U.S. Pat. No. 4,240,657 to Feighery and U.S. Pat. No. 3,124,383 to Cahan. With respect to the present invention, I believe that the firewood carrying devices shown in U.S. Pat. Nos. 4,248,464 and 4,299,525 are the closest prior art known to me.

BRIEF DESCRIPTION OF THE PRESENT INVENTION

The present invention is an improvement over the prior art in its versatility in usage, and its universality with respect to the types of firewood loading operations which can be accomplished with the device.

Broadly described, the firewood carrier of the invention includes a pair of elongated rods angled or bent intermediate their length to form a firewood stop and which project through a pair of handle bars. Each of the handle bars has a pair of bores formed therethrough adjacent the opposite ends of each bar to permit the rods to be slidably passed through the bores. Each of the two handle bars also has screw passageways bored axially into its opposite ends, and these screw passageways accommodate fastening devices, such as set screws, which can be inserted in the passageways and tightened against the elongated rods to fix their position relative to each other, and relative to the handle bars.

The described structure facilitates adjustment and repositioning of both the handle bars in relation to each other, and the elongated, wood supporting rods in relation to each other, so that the device can be used to afford more leverage in carrying sticks of firewood, and can also be used with equal facility to carry the firewood in a transverse orientation on the carrier for purposes of loading into an open fireplace, or in a longitudinally extending relationship to the carrier for purposes of loading into a wood burning stove.

An important object of the invention is to provide an improved firewood carrier which can be adjusted to enable it to be easily employed in loading sticks of firewood into either an open fireplace, or into a wood burning stove.

An additional object of the invention is to provide a firewood carrier which is of simple construction, can be relatively economically manufactured, requires no special training or skills in its use, and which is characterized in having a long and trouble-free operating life.

Additional objects and advantages of the invention will become apparent as the following detailed description of a preferred embodiment of the invention is read in conjunction with the accompanying drawings which illustrate the invention.

GENERAL DESCRIPTION OF THE DRAWINGS

DETAILED DESCRIPTION OF A PREFERRED EMBODIMENT OF THE INVENTION

The firewood carrier of the invention includes a pair of elongated wood supporting rods 10 and 12. The rods 10 and 12 are circular in cross section and carry serrations or teeth 13 intermediate their length. The rods 10 and 12 are also bent or angled intermediate their length. This bend or angulation forms a step 14 in each of the rods. Each of the rods is rounded at one or both ends as shown at 15.

Figure 3:
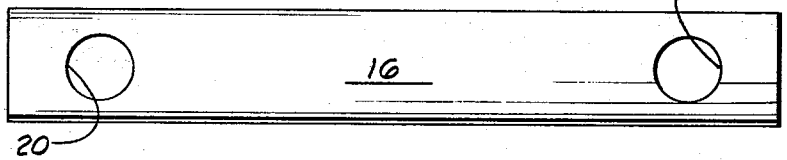
FIG. 3 is a side elevation view of one of the handle bars used in the firewood carrier.

The carrier further includes a pair of handle bars 16 and 18. The handle bars are cylindrical in configuration and in the illustrated embodiment are substantially equal in length. Each of the handle bars 16 and 18 is transversely bored at two locations which are adjacent the opposite ends of each bar. The bores in the bar 16 are illustrated in FIG. 3 and are designated by reference numerals 20 and 21. The bores are dimensioned to permit one of the rods 10 and 12 to be extended therethrough.

Each of the handle bars 16 and 18 has a bore or passageway formed inwardly into its opposite ends. Thus, the handle bar 16 defines the passageway 22 at its opposite ends, and the handle bar 18 defines passageway 24 at its opposite ends. The passageways 22 and 24 are internally threaded, in the illustrated embodiment, so that externally threaded allen head screws 30, 32, 34 and 36 can be threaded into the respective passageways. At their inner ends the passageways 20 and 24 intersect the adjacent transverse bores through the handle bars 16 and 18 through which the rods 10 and 12 are passed. Thus, the set screws prevent the rods from rotating in the handle bars when the carrier is in use, but permit rotation of these rods to adjust the shape of the carrier according to the utilization which is to be made of it.

Figure 1:
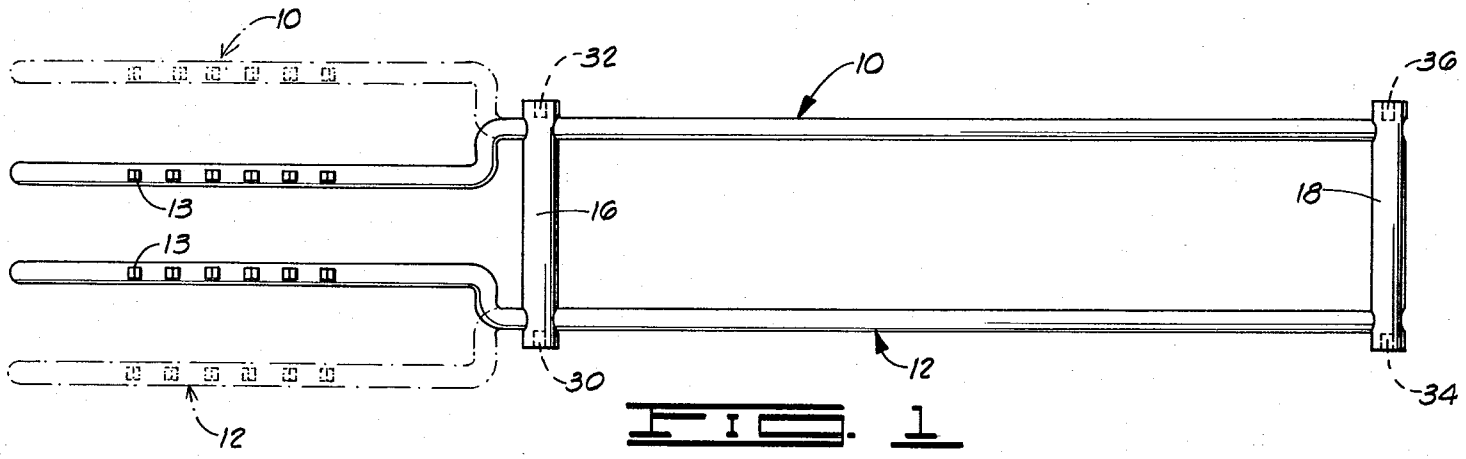
FIG. 1 is a plan view illustrating a preferred embodiment of the present invention. Two alternate positions of the elongated wood carrying rods are illustrated, with the alternate position depicted in dashed lines.
Figure 2:
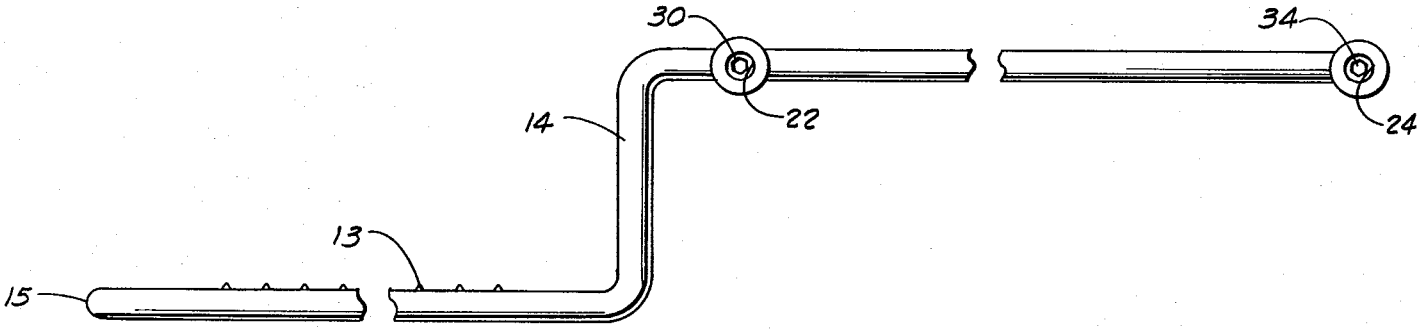
FIG. 2 is a side elevation view of the wood carrier of the invention.

As illustrated in FIG. 1 of the drawings, the supporting rods 10 and 12 can be placed in at least two alternate positions. In one of these positions, the rods 10 and 12 including their angulations extend in substantially parallel planes and are eqidistant from each other over their entire lengths. This position is that which is best suited for lifting and supporting sticks of firewood in a longitudinally extending relationship to the firewood carrier. Stated differently, the logs lay upon the supporting rods 10 and 12 lengthwise. This permits the logs to be easily inserted through the relatively narrow or small openings provided on many wood burning stoves.

If it should be desired to adjust the carrier for use in placing sticks of firewood in an open fireplace, this is accomplished by loosening the set screws 30–36 using an allen wrench so that the rods 10 and 12 can be rotated about their longitudinal axes and thereby cause to become further spaced from each other at their log carrying end portions. This position is shown in dashed lines in FIG. 1. It will be apparent from the description of the manner in which the rods are adjusted in their positional relationship to each other that the log carrying ends of the rods can be spaced even further apart where longer logs are to be carried and placed. The teeth 13 carried on the rods bite into the logs carried thereon and prevent them from slipping laterally.

It will also be noted that by loosening the set screws 30 and 32 the handle bar 16 can be slid toward or away from the handle bar 18. The leverage which is thus provided in lifting a log can be altered or changed. Moreover, the forward hand, which, in using the carrier is closest to the log being carried, can be moved farther out toward the handle bar 16 in instances where there is an intense fire into which the log is to be placed. The forward hand is thus better protected from the radiant heat.

From the foregoing description of the invention, it will be perceived that this invention provides a very simple, yet highly versatile device which can be easily used without special skills on the part of the user. Moreover, and importantly, the manufacturer of the firewood carrier need make only one version of the device to afford the dual function of placing logs in a fireplace, as well as placing them in a wood burning stove. The purchaser of the carrier device can adjust it as may be needed for his own needs.

Although a particular and preferred embodiment of the firewood carrier of the invention has been herein described in order to provide adequate illustration of its basic principles to enable the invention to be practiced by those skilled in the art, it will be appreciated that various changes and innovations in the depicted and described firewood carrier can be made without departure from these basic principles. Changes of this type are therefore deemed to be within the spirit and scope of the invention except as the same may be necessarily limited by the appended claims or reasonable equivalents thereof.

What is claimed is:

1. A firewood carrier comprising:

a pair of spaced handle bars each defining a pair of transverse rod bores spaced inwardly from opposite ends thereof;

a pair of elongated rigid rods of circular cross-section and each having an angulation forming a step intermediate its ends, and said rods having portions extending parallel to each other and passing through the transverse rod bores in said handle bars; and fastening means projecting into said handle bars and into fastening contact with said rods at the locations where the rods pass through the transverse bores in said handle bars.

2. A firewood carrier as defined in claim 1 and further characterized as including:

a pair of passageways extending axially into the opposite ends of each of said handle bars and intersecting said rod bores; and wherein said fastening means is screws screwed into said passageways into contact with said rods.

3. A firewood carrier as defined in claim 2 wherein each of said rods has teeth formed therein on one side thereof and located along the respective rod on the opposite side of the step thereof from said handle bars.

* * * * *